US007896628B2

(12) United States Patent
Sindt et al.

(10) Patent No.: US 7,896,628 B2
(45) Date of Patent: Mar. 1, 2011

(54) DOWNHOLE MOTOR SEAL AND METHOD

(75) Inventors: Olivier Sindt, Cheltenham (GB); Geoff Downton, Minchinhampton (GB); Laurent Carteron, Cheltenham (GB); Francois Clouzeau, Battlesdown (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/385,946

(22) Filed: Mar. 21, 2006

(65) Prior Publication Data

US 2006/0216178 A1 Sep. 28, 2006

(30) Foreign Application Priority Data

Mar. 22, 2005 (GB) ..... 0505783.1

(51) Int. Cl.
*F03C 2/08* (2006.01)

(52) U.S. Cl. ..... 418/48; 418/153; 29/446

(58) Field of Classification Search ..... 418/1, 418/48, 152, 153; 29/446
See application file for complete search history.

(56) References Cited

U.S. PATENT DOCUMENTS

| | | | | | |
|---|---|---|---|---|---|
| 2,780,273 | A * | 2/1957 | Roberts | ..... | 156/144 |
| 3,691,268 | A * | 9/1972 | Burkley | ..... | 264/162 |
| 4,415,316 | A | 11/1983 | Jurgens | | |
| 4,585,607 | A * | 4/1986 | Krackeler et al. | ..... | 264/229 |
| 5,156,309 | A * | 10/1992 | Friedrich | ..... | 222/135 |
| 5,171,138 | A | 12/1992 | Forrest | | |
| 5,242,019 | A * | 9/1993 | Benker | ..... | 166/187 |
| 6,102,681 | A * | 8/2000 | Turner | ..... | 418/48 |
| 6,183,226 | B1 | 2/2001 | Wood | | |
| 6,245,174 | B1 * | 6/2001 | Cordia et al. | ..... | 156/160 |
| 6,461,128 | B1 | 10/2002 | Wood | | |
| 6,604,922 | B1 | 8/2003 | Hache | | |
| 7,131,827 | B2 * | 11/2006 | Jager et al. | ..... | 418/48 |
| 7,192,260 | B2 * | 3/2007 | Lievestro et al. | ..... | 418/48 |
| 2002/0084029 | A1 * | 7/2002 | Turner et al. | ..... | 418/48 |
| 2005/0079083 | A1 * | 4/2005 | Lievestro et al. | ..... | 418/48 |
| 2006/0029507 | A1 * | 2/2006 | Kaiser et al. | ..... | 418/48 |
| 2006/0131079 | A1 * | 6/2006 | Bottos | ..... | 175/107 |

* cited by examiner

*Primary Examiner*—Thomas E Denion
*Assistant Examiner*—Mary A Davis
(74) *Attorney, Agent, or Firm*—Vincent Loccisano; Jeremy P. Welch; Brigitte L. Echols

(57) ABSTRACT

The rotor of a downhole motor includes a mandrel having at least one radial lobe, and an elastomeric tubular sleeve compressed about the mandrel so as to establish frictional engagement therebetween. The sleeve is compressed about the mandrel through one of various processes, including heat shrinking, vacuum shrinking, and stretching.

8 Claims, 4 Drawing Sheets

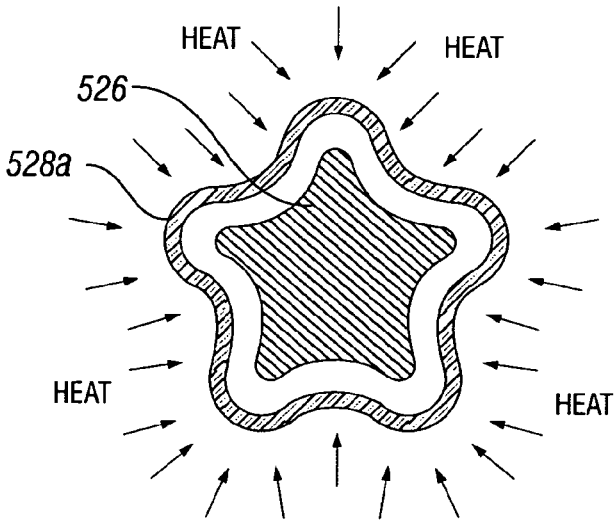
FIG. 5A
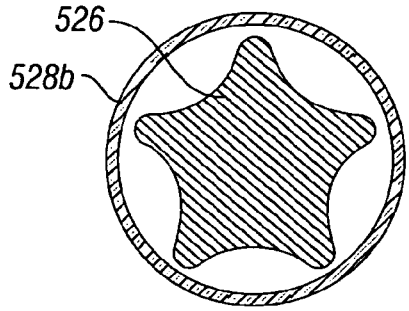
FIG. 5B
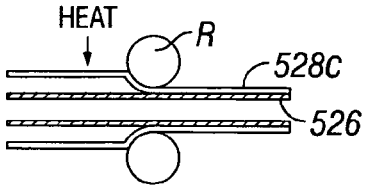
FIG. 5C
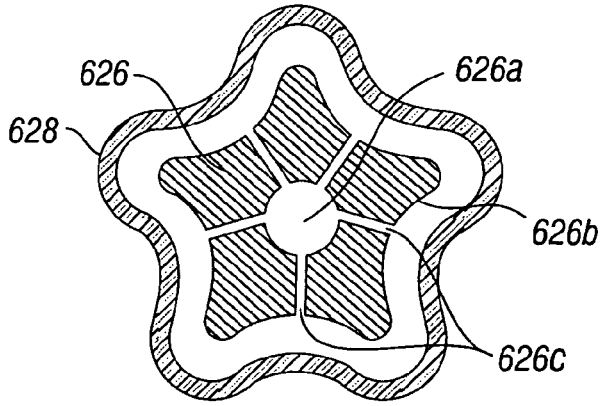
FIG. 6
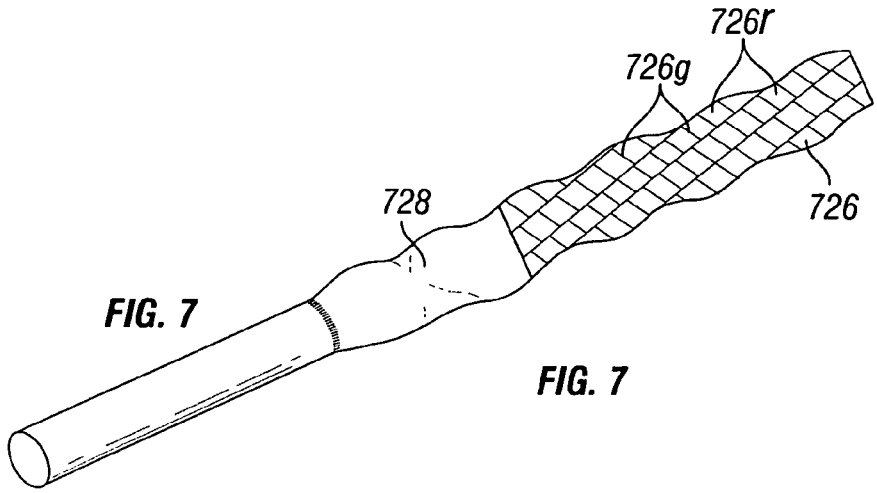
FIG. 7
FIG. 7

DOWNHOLE MOTOR SEAL AND METHOD

BACKGROUND OF THE INVENTION

1. Field of the Invention

The present invention relates to mud-driven motors used in the drilling of wellbores for hydrocarbon production. More particularly, the invention relates to the sealing elements employed within the power section of a downhole drilling motor.

2. Background of the Related Art

The concept of downhole motors for driving an oil well drill bit is more than one hundred years old. Modem downhole motors, also known as progressive cavity motors or simply mud motors, are powered by circulating drilling fluid (mud), which also acts as a lubricant and coolant for the drill bit, through a drill string in which a downhole motor is conveyed. Prior art FIG. 1 shows a conventional downhole motor assembly. The motor assembly 10 generally includes a rotatable drill bit 12, a bearing/stabilizer section 14, a transmission section 16 which may include an adjustable bent housing, and a motor power section 18. The bent housing 16 is not an essential part of the motor assembly, and is only used in directional drilling applications. During operation, drilling fluid pumped through the drill string 20 from the drilling rig at the earth's surface passes through the motor power section 18 and exits the assembly 10 through the drill bit 12.

Prior art FIGS. 2 and 3 show details of the power section 18 of a conventional downhole motor. The power section 18 generally includes a tubular housing 22 which houses a motor stator 24 within which a motor rotor 26 is rotationally mounted. The power section 18 converts hydraulic energy into rotational energy by reverse application of the Moineau pump principle. It will be appreciated by those skilled in the art that the difference between a "motor" and a "pump" as used herein is the direction of energy flow. Thus, a progressive cavity motor may be operated as a progressive cavity pump by direct (as opposed to reverse) application of the Moineau pump principle wherein rotational energy is converted into hydraulic energy. For the sake of clarity, the term "motor" will be used hereafter to mean a device that transforms energy between hydraulic energy and rotational energy, typically (but not exclusively) in the direction of a hydraulic-to-rotational energy transformation.

The stator 24 has a plurality of helical lobes, 24*a*-24*e*, which define a corresponding number of helical cavities, 24*a*'-24*e*'. The rotor 26 has a plurality of lobes, 26*a*-26*d*, which number one fewer than the number of stator lobes and which define a corresponding plurality of helical cavities 26*a*'-26*d*'. Generally, the greater the number of lobes on the rotor and stator, the greater the torque generated by the motor power section 18. Fewer lobes will generate less torque but will permit the rotor 26 to rotate at a higher speed. The torque output by the motor is also dependent on the number of "stages" of the motor, a "stage" being one complete spiral of the stator helix.

In conventional downhole motors, the stator 24 primarily consists of an elastomeric lining that provides the lobe structure of the stator. The stator lining is typically injection-molded into the bore of the housing 22, which limits the choice of elastomeric materials that may be used. During refurbishment, the stator must be shipped to a place where the injection molding can be performed. This increases the costs of maintenance of the motors.

The rotor is typically made of a suitable steel alloy (e.g., a chrome-plated stainless steel) and is dimensioned to form a tight fit (i.e., very small gaps or positive interference) under expected operating conditions, as shown in FIG. 3. It is generally accepted that either or both the rotor and stator must be made compliant in order to form suitable hydraulic seals. The rotor 26 and stator 24 thereby form continuous seals along their matching contact points which define a number of progressive helical cavities. When drilling fluid (mud) is forced through these cavities, it causes the rotor 26 to rotate relative to the stator 24.

The following patents disclose, in varying applications, the use of elastomeric liners that are molded, extruded, or bonded (e.g., chemically, thermally) to the rotor of a downhole motor, either to supplement or to replace the elastomeric liner of the stator: U.S. Pat. No. 4,415,316; U.S. Pat. No. 5,171,138; U.S. Pat. No. 6,183,226; U.S. Pat. No. 6,461,128; and U.S. Pat. No. 6,604,922. None of these patents discloses a rotor liner that is easily replaced, presumably because the described means of molding/extruding/bonding do not facilitate easy replacement.

Accordingly, a need exists for a solution of sealing the power section of a downhole motor in such a manner that facilitates easy replacement of the sealing elements. Moreover, a need exists for such a sealing solution that does not necessitate the expensive process of relining the motor stator to maintain an adequate seal in the power section.

SUMMARY OF THE INVENTION

In accordance with the needs expressed above, as well as other objects and advantages, the present invention provides a method for making the rotor of a progressive cavity motor, including the step of compressing an elastomeric tubular sleeve about a mandrel so as to establish frictional engagement between the mandrel and the tubular sleeve. The rotor mandrel has at least one radial lobe.

The tubular sleeve may be either cylindrically shaped or shaped according to the radial profile of the rotor mandrel before being compressed about the mandrel.

Each radial lobe of the rotor mandrel may be associated with a pair of helical channels that extend axially along the mandrel. When the rotor mandrel is so equipped, the tubular sleeve may be shaped according to the axial profile of the mandrel before being compressed about the mandrel.

In particular embodiments of the inventive method, the tubular sleeve includes a thermally shrinkable elastomer. In such embodiments, the compressing step may include positioning the mandrel within the tubular sleeve, and applying heat to the tubular sleeve. Additionally, the compressing step may include applying mechanical pressure to the tubular sleeve while applying heat thereto, such as in a rolling operation.

In particular embodiments of the inventive method, the compressing step may include positioning the mandrel within the tubular sleeve, sealing the ends of the tubular sleeve to the mandrel, and creating a pressure differential across the tubular sleeve. The mandrel may include an elongated axial bore and a plurality of perforations extending from the axial bore to an outer surface of the mandrel, so that the pressure differential may be created by applying suction to the axial bore of the mandrel. Additionally, a pressure differential may be created across the tubular sleeve by applying increased fluid pressure to the outer surface of the sleeve while relieving the pressure on the inner surface of the sleeve.

In particular embodiments of the inventive method, the tubular sleeve has an inner diameter in its relaxed state that is less than the outer diameter of the mandrel. In such embodiments, the compressing step includes elastically expanding and sliding the tubular sleeve axially over the mandrel.

In particular embodiments, the inventive method further including the step of applying an adhesive to at least one of the mandrel's outer surface and the tubular sleeve's inner surface so as to enhance the compressing step.

In another aspect, the present invention provides a rotor for a progressive cavity motor. The rotor includes a mandrel having at least one radial lobe, and an elastomeric tubular sleeve compressed about the mandrel so as to establish frictional engagement therebetween.

In particular embodiments of the invention rotor, at least one of the mandrel's outer surface and the tubular sleeve's inner surface is rough to enhance the frictional engagement of the tubular sleeve with the mandrel. The surface roughness may be provided by one of grooves, ribs, indentations, protuberances, or a combination thereof.

Similarly, the mandrel's outer surface and the tubular sleeve's inner surface may be equipped with complementary fastener means to enhance the frictional engagement of the tubular sleeve with the mandrel.

In a further aspect, the present invention provides a progressive cavity motor, including a rotor and a stator. The rotor includes a mandrel having at least one radial lobe, and an elastomeric tubular sleeve compressed about the mandrel so as to establish frictional engagement therebetween. The stator may have an inner elastomeric surface.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIGS. 5A and 5B are schematic representations of the different shapes employed by tubular sleeves before being compressed about a rotor mandrel according to the present invention. FIG. 5A further illustrates heat being applied to the tubular sleeve according to one embodiment of the present invention.

FIG. 5C is a schematic representation of a heated rolling process for compressing a tubular sleeve about a mandrel in accordance with the present invention.

FIG. 6 illustrates a rotor mandrel equipped for applying suction to a tubular sleeve according to another embodiment of the present invention.

FIG. 7 illustrates a tubular sleeve being expanded and slid over a rotor mandrel according to a further embodiment of the present invention.

DETAILED DESCRIPTION OF THE INVENTION

Figure 1:
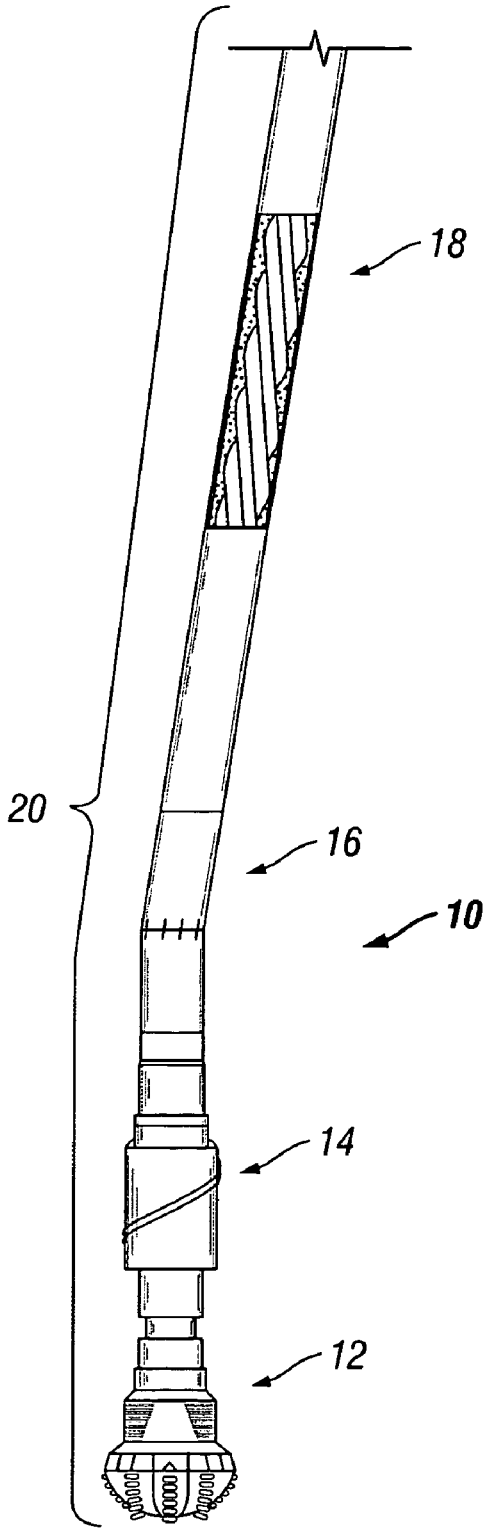
FIG. 1 (Prior Art)
FIG. 1 illustrates a prior art downhole motor, partially in section, used to drive a drill bit.
Figure 2:
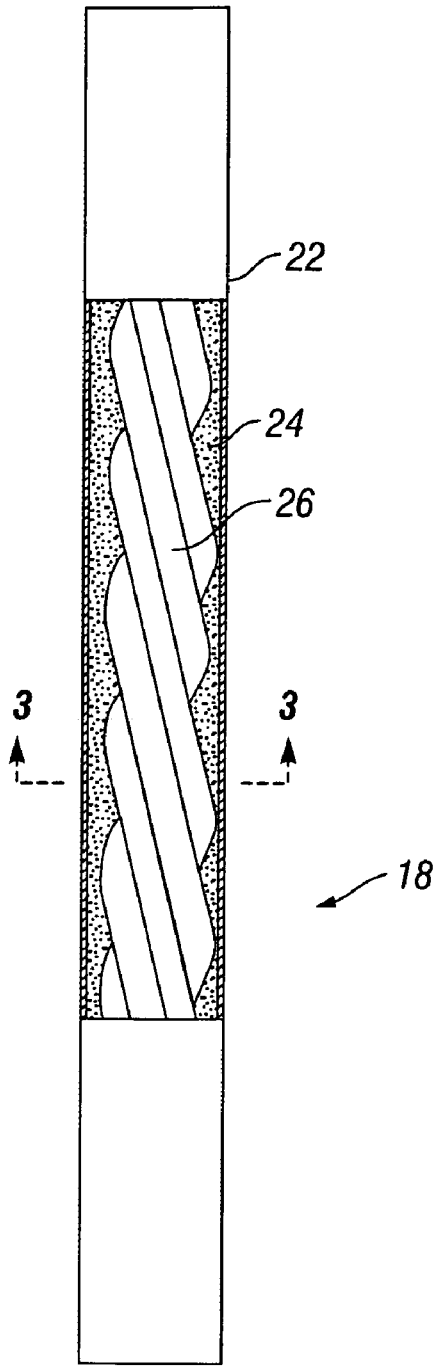
FIG. 2 (Prior Art)
FIG. 2 is shows a detailed view of the power section of the downhole motor of FIG. 1.
Figure 3:
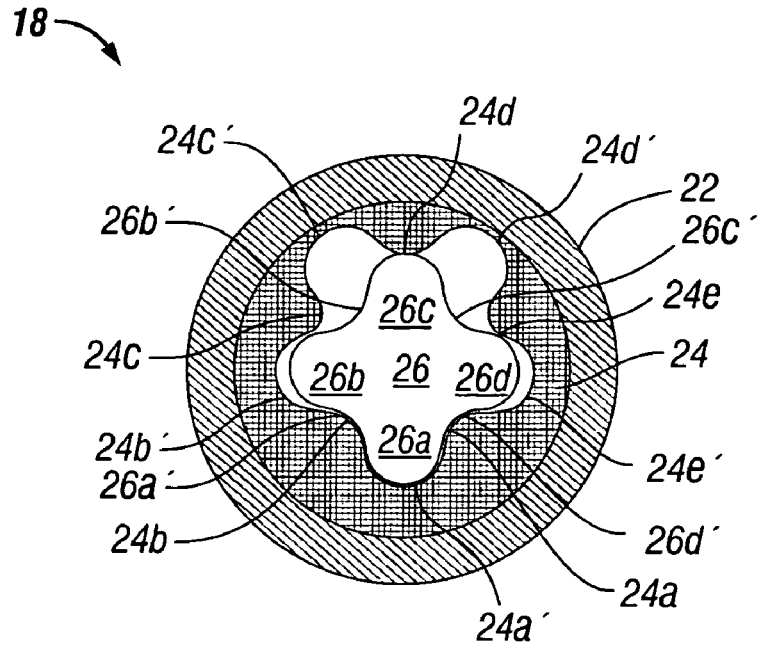
FIG. 3 (Prior Art)
FIG. 3 is a cross-sectional view of the power section of the downhole motor, taken along section line 3-3 of FIG. 2.
Figure 4:
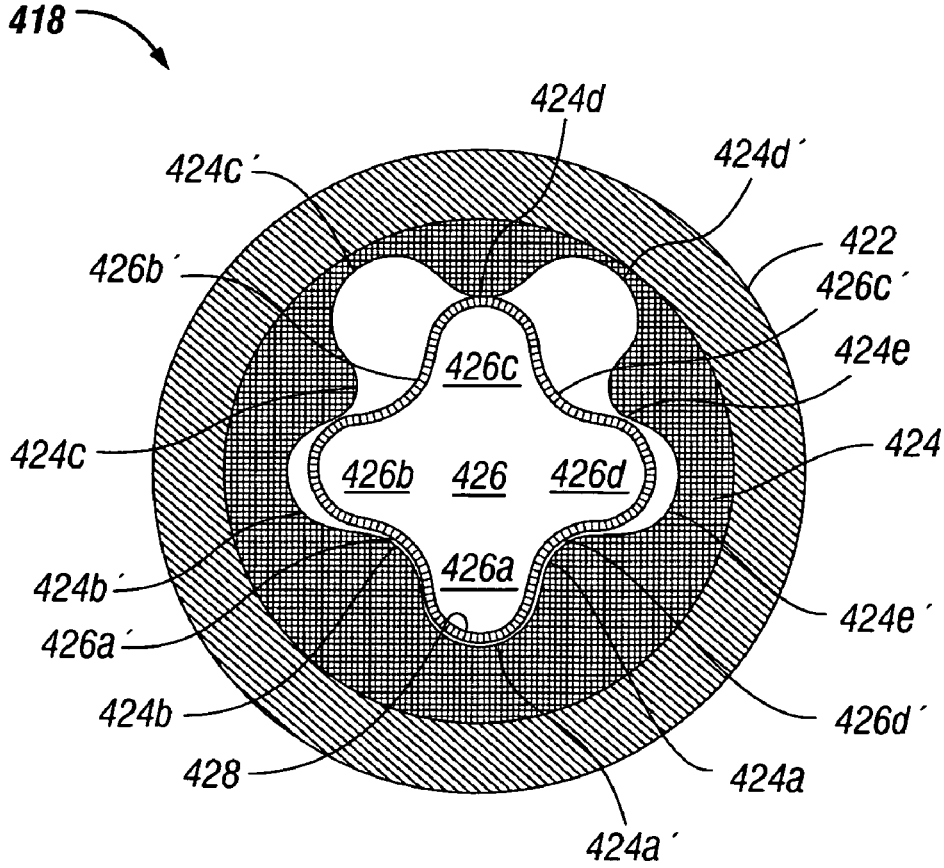
FIG. 4 is a cross-sectional view of the power section of a downhole motor according to the present invention.

FIG. 4 shows a cross-sectional view of the power section 418 of a downhole motor according to the present invention. The power section 418 generally includes a tubular housing 422 which houses a motor stator 424 within which a motor rotor 426 is rotationally mounted. The power section 418 converts hydraulic energy into rotational energy by reverse application of the Moineau pump principle, as is well known.

The stator 424 has five helical lobes, 424*a*-424*e*, which define five helical cavities, 424*a*'-424*e*'. The stator may be constructed substantially of a chrome-plated stainless steel, similar to the makeup of conventional rotors, but the present invention does not preclude the stator from incorporating an elastomeric inner portion in the traditional manner. Thus, the stator may forego—or alternatively employ—elastomeric material for its inner profile. In the former case, the sealing utility of the motor's progressing cavities would be ensured by an elastomeric sleeve on the rotor (described below). In the latter case, the sealing of the motor's progressing cavities would be ensured by a combination of the rotor's elastomeric sleeve and the stator's elastomeric inner body. The choice will depend on the anticipated refurbishment requirements and sealing efficiency concerns for particular applications.

The rotor includes a mandrel 426 having four helical lobes, 426*a*-426*d*, one fewer than the number of stator lobes. FIG. 4 thus shows a "4/5" (i.e., four lobes for the rotor, and five lobes for the stator) power section 418, but those having ordinary skill in the art will appreciate that the present invention is well adapted to other configurations (e.g., a "5/6" power section, or even "1/2" or "2/3" power sections) that may be more desirable depending on the drilling application. The rotor lobes define four helical cavities 26*a*'-26*d*', with each rotor lobe (e.g., 426*a*) being associated with two helical cavities (e.g., 426*a*', 426*d*').

An elastomeric tubular sleeve 428 is compressed about the mandrel 426 so as to envelop the outer surfaces of the lobes 426*a-d* and channels 426*a*'-*d*' thereof, thereby establishing frictional engagement between the mandrel and the tubular sleeve. This engagement is sufficient to resists slippage between the mandrel 426 and the sleeve 428 as the rotor is rotated within the stator 424 by the force of the drilling mud circulated through the drill string (not shown in FIG. 4). The thickness of the tubular sleeve 428 is depicted as being uniform, but this is not essential. Thus, the sleeve thickness may vary along its profile as needed, e.g., to define the lobe configuration for the rotor and/or for reinforcing areas undergoing concentrated stress/strain.

The tubular sleeve may be formed in various shapes, e.g., shaped according to the radial profile of the rotor mandrel (see sleeve 528*a* in FIG. 5A) or simply cylindrically shaped (see sleeve 528*b* in FIG. 5B). Also, in the case where the tubular sleeve is shaped according to the radial profile of the rotor, the sleeve may—or may not—be shaped according to the helical channels that define the axial profile of the mandrel. The sleeve's initial shape and form (i.e., before being compressed about the mandrel) is dictated in part by the method in which the sleeve is compressed. Thus, e.g., in compression methods wherein the tubular sleeve is actively shrunk upon the mandrel, the sleeve's central axial opening will by wide enough to have some clearance between the sleeve and the mandrel when the mandrel is positioned within the sleeve, as shown in FIGS. 5A-B. Generally, however, the tubular sleeve may employ any shape and form that would allow an ultimate tight fit between the rotor mandrel and the sleeve. Thus, e.g., other cross-sectional shapes (triangular, square, oval, etc . . . ) and profile variations of thickness may be employed.

In particular embodiments, the tubular sleeve includes a thermally shrinkable elastomer, e.g., a fluoroelastomer such as viton. Accordingly, FIG. 5A illustrates a tubular sleeve 528*a* positioned within a mandrel 526, and being thermally compressed upon the mandrel by applying heat to the tubular sleeve, i.e., heat-shrinking the sleeve about the mandrel. Such thermal compression may be complemented by the application of mechanical pressure, such as by a heated rolling process. FIG. 5C thus illustrates the use of rollers R for applying mechanical pressure along with heat to compress a tubular sleeve 528*c* upon a mandrel 526.

FIG. 6 illustrates an alternative manner of compressing the tubular sleeve about the mandrel. In this instance, a rotor 626 is equipped for applying suction to the inner surface of a tubular sleeve 628 so as to reduce under a pressure differential (and thereby compress) the sleeve about the mandrel. The mandrel 626 includes an elongated axial bore 626*a* and a plurality of perforations 626*b* distributed about and along the length of the mandrel. Each perforation 626*b* extends from the axial bore to an outer surface 626*c* of the mandrel. The ends (not shown) of the tubular sleeve are sealed to the mandrel (e.g., at or near the respective mandrel ends), and suction is applied to the axial bore 626*a* of the mandrel. The suction pressure is distributed around the profile length of the mandrel 626 by means of the perforations 626*b*. Accordingly, the suction pressure holds the tubular sleeve 628 in close contact with the mandrel 626. It will be appreciated that other means of creating a pressure differential across the tubular sleeve may be employed to advantage. Thus, e.g., increased air pressure (or other fluid pressure) may be applied to the outer surface of the tubular sleeve while relieving the pressure on the inner surface of the tubular sleeve, e.g., using a relief valve and/or applying suction.

It will be appreciated by those skilled in the art that the processes depicted in FIGS. 5A and 6 may be combined to advantage. In other words, the tubular sleeve may be compressed about the rotor mandrel through an "assisted" thermal process wherein heat shrinking is combined with the application of either internal suction pressure or external high pressure applied to the sleeve.

FIG. 7 illustrates a further process for compressing a tubular sleeve about the rotor mandrel. In this embodiment, a sleeve 728 is elastically expanded and slid over a mandrel 726 across the mandrel's length. The tubular sleeve 728 has an inner diameter in its relaxed state that is less than the outer diameter of the mandrel 726, but diameters are within a range that permits the sleeve to be reliably expanded over the mandrel without substantial risk of plastic deformation or tearing.

Figure 8:
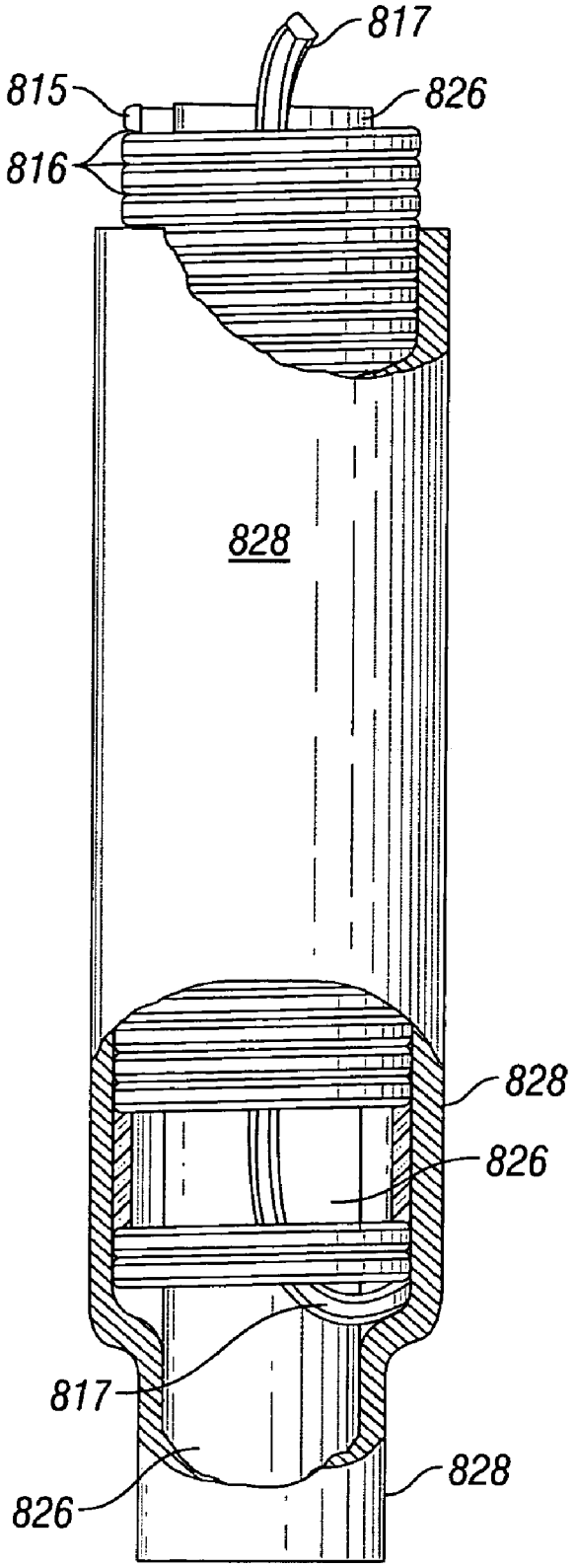
FIG. 8 illustrates a tubular sleeve having a removable inner shell according to a further embodiment of the present invention.

FIG. 8 illustrates a still further process for compressing a tubular sleeve about the rotor mandrel. In this embodiment, an elastomeric sleeve 828 is slipped over one of the ends of a mandrel 826 into a position enveloping the mandrel, and a tubular support within the sleeve is removed to permit the sleeve 828 to contract and form a tight fit about the mandrel 826. The support is defined by a unitary tubular shell 815 that is helically grooved along its entire length. The continuous groove 816 permits the shell 815 to be incrementally removed (or unwound) from the annular region between the sleeve 828 and the mandrel 826 in tearing-like fashion, producing a strip 817. The sleeve 828, equipped with the shell 815 about its inner surface, is initially stretched axially and/or radially about the mandrel 826. As the strip 817 is progressively withdrawn from the shell 815, the sleeve 828 contracts about the mandrel 826 to form a closely conforming and tightly retained covering, as shown in the lower portion of FIG. 8. Such compression of the sleeve 828 results in the application of a resultant force against the remaining end of the shell 815, and thereby assists in the removal of the strip 817 as the shell 815 is unwound. Commercial examples of similar sleeve/shell devices include the Cold Shrink™ insulator series offered by 3M, which may be adaptable for use as described above.

It will be appreciated by those having ordinary skill in the art that fabricating a rotor according to the processes of FIGS. 6-8 has the advantage of availing itself to any elastomeric material that can be extruded or otherwise made in the desired shape and form for the sleeve. Thus, e.g., reinforced elastomers such as those incorporating fibers made of carbon, glass, metal, etc., could be used to fabricate the sleeve.

Alternative embodiments of the present invention incorporate additional measures to prevent relative movement between the tubular sleeve and rotor mandrel under the forces exerted by the drilling mud. Thus, an adhesive may be applied to at least one of the mandrel's outer surface and the tubular sleeve's inner surface before the sleeve is compressed about the mandrel so as to enhance the frictional engagement between the two. The adhesive could be a "permanent" glue, compatible both with the sleeve elastomer(s) and the mandrel's steel makeup. The adhesive could also be pressure sensitive so that it would activate and adhere only when the sleeve is tightly compressed into contact with the mandrel's metallic body.

Such a pressure-sensitive adhesive could be pre-applied to the inner surface of the tubular sleeve 828 (described above) during manufacturing. This would be simpler, e.g., than first applying the adhesive to the outer surface of the mandrel 826 before placing the sleeve 828 and tubular shell 815 thereabout. In addition, the pre-application of the adhesive to the sleeve would avoid the risk of the strip 817 scraping off a portion of the glue when pulled free of the shell 815.

Moreover, the adhesive could comprise a two-part composition of components that individually did not adhere to the sleeve or the mandrel, but when applied to each other formed a strong bond. One component part of the adhesive would, e.g., be pre-applied to the inner surface of the tubular sleeve, while the other component part would be applied to the outer surface of the mandrel just prior to assembly. A particular process for applying the second adhesive component to the surface of the mandrel could include a spray nozzle for providing thin, even coverage.

Additionally, at least one of the mandrel's outer surface and the tubular sleeve's inner surface may be roughened to enhance the frictional engagement of the tubular sleeve with the mandrel and inhibit relative movement therebetween. The surface roughness may be provided in numerous ways, e.g., by one of grooves, ribs, indentations, protuberances, or a combination thereof. Thus, e.g., a series of grooves 726*g* and ribs 726*r* could be machined into the metallic body of the rotor mandrel 726, as shown in FIG. 7. The tubular sleeve 728 could be provided with a similar but opposing pattern on its inner surface (not shown), so that when the sleeve is tightly fitted onto the metallic body of the mandrel, these two patterns interlock and prevent relative movement. Such surface treatment, while only illustrated in the embodiment of FIG. 7, is applicable to other embodiments (e.g., as shown in FIGS. 5A-B, 6) according to the present invention.

Similarly, the mandrel's outer surface and the tubular sleeve's inner surface may be equipped with complementary fastener means, such as the well known VELCRO® hook and loop fasteners, to enhance the frictional engagement of the tubular sleeve with the mandrel.

Those skilled in the art will appreciate that the lined rotor, and its implementation if a downhole motor, may be employed to advantage according to the embodiments described herein as well as others. For example, it will be appreciated that a tubular sleeve according to the present invention will facilitate easy removal and replacement thereof in a maintenance operation. Such removal may be enhanced by using water jets, chemical means, and mechanical means such as abrasion, but in many embodiments such additional removal means are unnecessary.

It will further be understood from the foregoing description that various modifications and changes may be made in the preferred and alternative embodiments of the present invention without departing from its true spirit. For example, another method of compressing a tubular sleeve about a mandrel could include the steps of sealing one end of the sleeve, inflating the sleeve, inserting the rotor mandrel into the expanded sleeve from the non-sealed end, and then deflating the expanded sleeve into tight engagement about the mandrel.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded.

What is claimed is:

1. A method for making a rotor of a progressive cavity motor, comprising the step of:

placing an elastomeric tubular sleeve, formed of a thermally shrinkable elastomer, about a rotor mandrel having at least one radial lobe so as to establish frictional engagement between the rotor mandrel and the tubular sleeve, wherein the rotor mandrel's outer surface provides a roughened surface to enhance the frictional engagement of the tubular sleeve with the rotor mandrel;

applying heat to shrink the thermally shrinkable elastomer until the rotor mandrel's outer surface securely and frictionally engages the tubular sleeve's inner surface along the roughened surface; and inserting the rotor with the secured thermally shrinkable elastomer into the progressive cavity motor.

2. The method of claim 1, wherein the elastomeric tubular sleeve is cylindrically shaped before being compressed about the rotor mandrel.

3. The method of claim 1, wherein the tubular sleeve is shaped according to the radial profile of the rotor mandrel before being compressed about the mandrel.

4. The method of claim 1, wherein each of the at least one radial lobe is associated with a pair of helical channels that extend axially along the rotor mandrel.

5. The method of claim 4, wherein the elastomeric tubular sleeve is shaped according to the axial profile of the rotor mandrel before being compressed about the mandrel.

6. The method of claim 1, wherein the surface roughness is provided by one of grooves, ribs, indentations, protuberances, or a combination thereof.

7. The method of claim 1, further comprising positioning the rotor mandrel within the elastomeric tubular sleeve before applying heat to the elastomeric tubular sleeve.

8. The method of claim 7, further comprising applying mechanical pressure to the elastomeric tubular sleeve while applying heat thereto.

* * * * *